US007686139B2

(12) United States Patent
Kondo et al.

(10) Patent No.: US 7,686,139 B2
(45) Date of Patent: Mar. 30, 2010

(54) ELEVATOR DEVICE

(75) Inventors: Rikio Kondo, Tokyo (JP); Hiroshi Kigawa, Tokyo (JP); Takaharu Ueda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 61 days.

(21) Appl. No.: 12/064,910

(22) PCT Filed: Jul. 27, 2006

(86) PCT No.: PCT/JP2006/314885

§ 371 (c)(1),
(2), (4) Date: Feb. 26, 2008

(87) PCT Pub. No.: WO2008/012895

PCT Pub. Date: Jan. 31, 2008

(65) Prior Publication Data

US 2009/0145698 A1 Jun. 11, 2009

(51) Int. Cl.
*B66B 1/32* (2006.01)
*B66B 5/16* (2006.01)

(52) U.S. Cl. ..... 187/391; 187/393; 187/314; 187/277

(58) Field of Classification Search ..... 187/247, 187/277, 287, 290, 306, 313, 314, 391–393, 187/377–379

See application file for complete search history.

(56) References Cited

U.S. PATENT DOCUMENTS

| | | | | |
|---|---|---|---|---|
| 3,613,835 | A * | 10/1971 | Vizzotto | 187/288 |
| 3,785,463 | A * | 1/1974 | Kuhl et al. | 187/295 |
| 4,083,431 | A * | 4/1978 | Oohira et al. | 187/296 |
| 7,434,664 | B2 * | 10/2008 | Helstrom | 187/314 |
| 2007/0170010 | A1 * | 7/2007 | Higashinaka | 187/374 |
| 2009/0133964 | A1 * | 5/2009 | Ueda et al. | 187/254 |

FOREIGN PATENT DOCUMENTS

| | | |
|---|---|---|
| JP | 7157211 | 6/1995 |
| JP | 7 206288 | 8/1995 |
| JP | 7 242377 | 9/1995 |
| JP | 2003-221171 A | 8/2003 |
| JP | 2006 8333 | 1/2006 |

OTHER PUBLICATIONS

U.S. Appl. No. 11/908,851, filed Sep. 17, 2007, Kondo, et al.
U.S. Appl. No. 12/064,394, filed Feb. 21, 2008, Ueda, et al.

* cited by examiner

*Primary Examiner*—Walter Benson
*Assistant Examiner*—Eduardo Colon-Santana
(74) *Attorney, Agent, or Firm*—Oblon, Spivak, McClelland, Maier & Neustadt, L.L.P.

(57) ABSTRACT

In an elevator apparatus, a brake device for braking the running of a car is controlled by a brake control device. The brake control device monitors a speed of the car and a degree of deceleration of the car at a time of emergency braking of the car. When the degree of deceleration of the car reaches a preset target deceleration, the brake control device generates a target speed pattern for decelerating the car from a speed of the car at that time.

5 Claims, 7 Drawing Sheets

ELEVATOR DEVICE

TECHNICAL FIELD

The present invention relates to an elevator apparatus having a brake control device capable of controlling a braking force at a time of emergency braking.

BACKGROUND ART

In a conventional elevator apparatus, at a time of an emergency stop, the current supplied to a brake coil is controlled to control a degree of deceleration of a car variably. At the time of the emergency stop, a speed command based on an emergency stop speed reference pattern having a predetermined deceleration is output from a speed reference generating portion (e.g., see Patent Document 1).

Patent Document 1: JP 07-206288 A

DISCLOSURE OF THE INVENTION

Problem to be Solved by the Invention

In the conventional elevator apparatus configured as described above, the speed of the car is made to follow the emergency stop speed reference pattern which is determined uniquely, so an excessively high deceleration may be generated when the speed of the car is first set on the emergency stop speed reference pattern.

That is, the supply of a current to a motor is also shut off when the car is stopped as an emergency measure, so the car may be accelerated or decelerated due to an imbalance between a load on the car side and a load of a counterweight from a moment when an emergency stop command is issued to a moment when a braking force is actually generated (to moment when a brake shoe comes into abutment on a brake pulley). Meanwhile, the degree of deceleration of the car can be controlled only after the braking force is actually generated. Thus, when the difference between an actual speed of the car and a target speed determined from the emergency stop speed reference pattern increases due to a degree of acceleration or deceleration of the car immediately after the issuance of the emergency stop command, a high deceleration may be generated to make up the difference.

The present invention has been made to solve the above-mentioned problem, and it is therefore an object of the present invention to provide an elevator apparatus capable of more reliably preventing an excessively high deceleration from being produced at the time of emergency braking.

Means for Solving the Problem

An elevator apparatus according to the present invention includes: a car; a brake device for braking running of the car; and a brake control device for controlling the brake device, in which the brake control device monitors a speed of the car and a degree of deceleration of the car at a time of emergency braking of the car, and generates, at a time when the degree of deceleration of the car reaches a preset target deceleration, a target speed pattern for decelerating the car from a speed of the car at the time.

BEST MODES FOR CARRYING OUT THE INVENTION

Preferred embodiments of the present invention will be described hereinafter with reference to the drawings.

Embodiment 1

Figure 1:
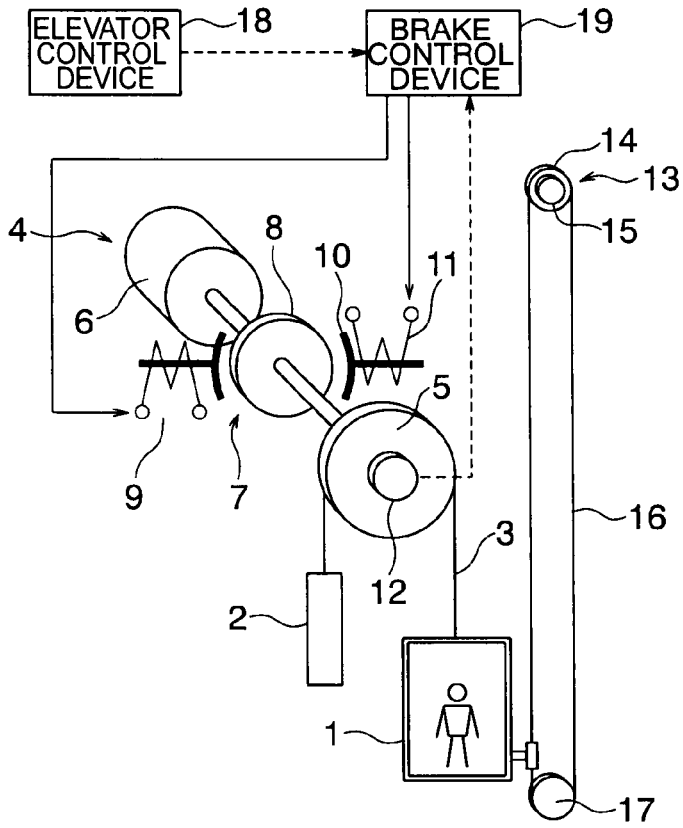
FIG. 1 is a schematic diagram showing an elevator apparatus according to Embodiment 1 of the present invention.

FIG. 1 is a schematic diagram showing an elevator apparatus according to Embodiment 1 of the present invention. Referring to FIG. 1, a car 1 and a counterweight 2, which are suspended within a hoistway by a main rope (suspension means) 3, are raised/lowered within the hoistway due to a driving force of a hoisting machine 4. The hoisting machine 4 has a drive sheave 5 around which the main rope 3 is looped, a motor 6 for rotating the drive sheave 5, and braking means 7 for braking rotation of the drive sheave 5.

The braking means 7 has a brake pulley 8 that is rotated integrally with the drive sheave 5, and a brake device 9 for braking rotation of the brake pulley 8. A brake drum, a brake disc, or the like is employed as the brake pulley 8. The drive sheave 5, the motor 6, and the brake pulley 8 are provided coaxially.

The brake device 9 has a plurality of brake shoes 10 that are moved into contact with and away from the brake pulley 8, a plurality of brake springs for pressing the brake shoes 10 against the brake pulley 8, and a plurality of electromagnets for opening the brake shoes 10 away from the brake pulley 8 against the brake springs. Each of the electromagnets has a brake coil (electromagnetic coil) 11, which is excited by supplying a current thereto.

By causing a current to flow through the brake coils 11, the electromagnets are excited, so an electromagnetic force for canceling the braking force of the brake device 9 is generated. As a result, the brake shoes 10 are opened away from the brake pulley 8. By shutting off the supply of the current to the brake coils 11, excitation of the electromagnets is cancelled, so the brake shoes 10 are pressed against the brake pulley 8 due to spring forces of the brake springs. In addition, the degree of the opening of the brake device 9 can be controlled by controlling the value of the current flowing through the brake coils 11.

The motor 6 is provided with a hoisting machine encoder 12 serving as a speed detector for generating a signal corresponding to a rotational speed of a rotary shaft of the motor 6, namely, a rotational speed of the drive sheave 5.

A speed governor 13 is installed in an upper portion of the hoistway. The speed governor 13 has a speed governor sheave 14, and a speed governor encoder 15 for generating a signal corresponding to a rotational speed of the speed governor sheave 14. A speed governor rope 16 is looped around the speed governor sheave 14. The speed governor rope 16 is connected at both ends thereof to an operation mechanism for an emergency stop device mounted on the car 1. The speed governor rope 16 is looped at the lower end thereof around a tension pulley 17 disposed in a lower portion of the hoistway.

The driving of the hoisting machine 4 is controlled by an elevator control device 18. That is, the raising/lowering of the car 1 is controlled by the elevator control device 18. The brake device 9 is controlled by a brake control device 19. Signals from the elevator control device 18 and the hoisting machine encoder 12 are input to the brake control device 19.

Figure 2:
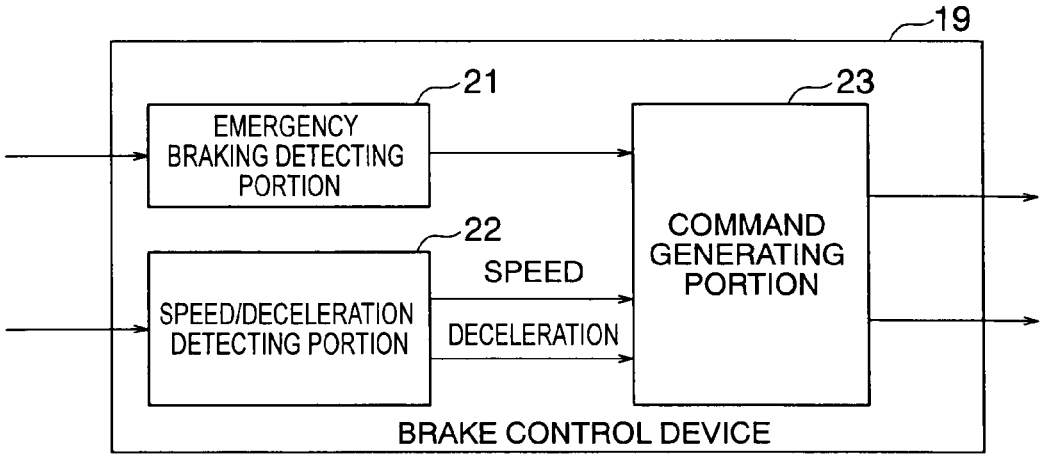
FIG. 2 is a block diagram showing a brake control device of FIG. 1.

FIG. 2 is a block diagram showing the brake control device 19 of FIG. 1. The brake control device 19 has an emergency braking detecting portion 21, a speed/deceleration detecting portion 22, and a command generating portion 23. The emergency braking detecting portion 21 determines whether or not the brake device 9 is in an emergency braking state, based on the signal from the elevator control device 18. The speed/deceleration detecting portion 22 detects (calculates) a speed and a degree of deceleration of the car 1 based on the signal from the hoisting machine encoder 12.

The command generating portion 23 generates a command to be delivered to the brake device 9 in accordance with the speed and the degree of deceleration of the car 1 which are detected by the speed/deceleration detecting portion 22, when the emergency braking detecting portion 21 obtains a determination result that the brake device 9 is in the emergency braking state. More specifically, the command generating portion 23 monitors the speed and the degree of deceleration of the car 1 at the time of emergency braking of the car 1. When the degree of deceleration of the car 1 reaches a preset target deceleration, the command generating portion 23 generates a target speed pattern for decelerating the car 1 at a predetermined deceleration from the speed of the car 1 at that time. In this example, when the degree of deceleration of the car 1 reaches the target deceleration, the command generating portion 23 generates a target speed pattern for decelerating the car 1 so as to maintain the target deceleration.

The function of the brake control device 19 is realized by a microcomputer. That is, programs for realizing the functions of the emergency braking detecting portion 21, the speed/deceleration detecting portion 22, and the command generating portion 23 are stored in the microcomputer of the brake control device 19.

Figure 3:
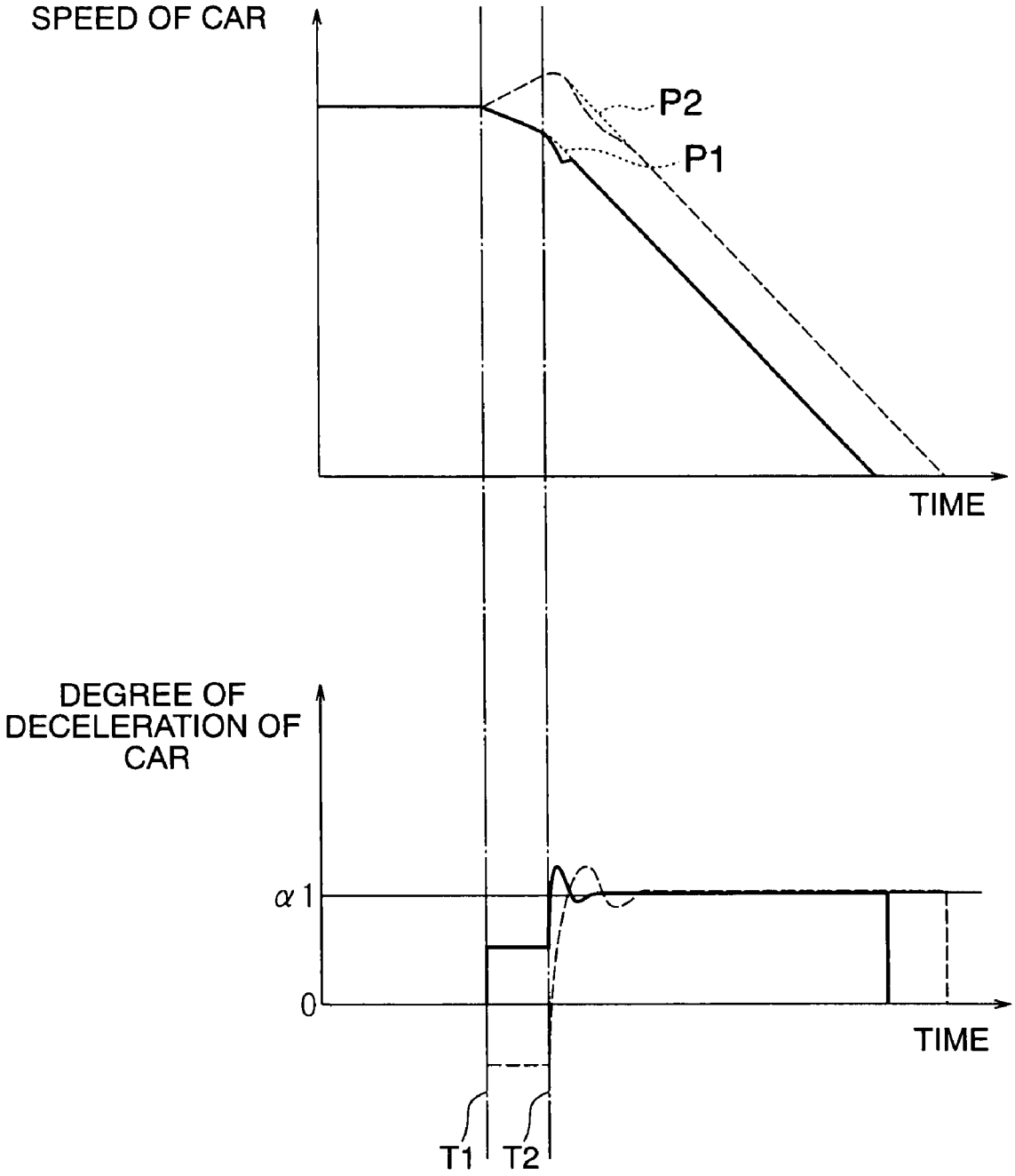
FIG. 3 includes graphs showing how the speed and the degree of deceleration of the car change with time, respectively, in a case where the brake control device of FIG. 2 performs deceleration control at a time of emergency braking.

FIG. 3 includes graphs showing how the speed and the degree of deceleration of the car 1 change with time, respectively, in a case where the brake control device 19 of FIG. 2 performs deceleration control at a time of emergency braking. Referring to FIG. 3, when an emergency stop command is issued at a time instant T1, a braking force is generated at a time instant T2. The car 1 is either decelerated (as indicated by solid lines of FIG. 3) or temporarily accelerated (as indicated by coarse broken lines of FIG. 3) immediately after the issuance of an emergency stop command. In either case, when the degree of deceleration of the car 1 reaches a target deceleration $\alpha$1, the car 1 is decelerated and stopped along a corresponding one of target speed patterns P1 and P2 (as indicated by fine broken lines of FIG. 3) according to which the car 1 continues to be decelerated at the deceleration $\alpha$1 from a speed of the car 1 at that time.

Accordingly, the target speed pattern P1 in the case where the car 1 is decelerated immediately after the issuance of the emergency stop command and the target speed pattern P2 in the case where the car 1 is temporarily accelerated immediately after the issuance of the emergency stop command have the same gradient and are parallel to each other.

Figure 4:
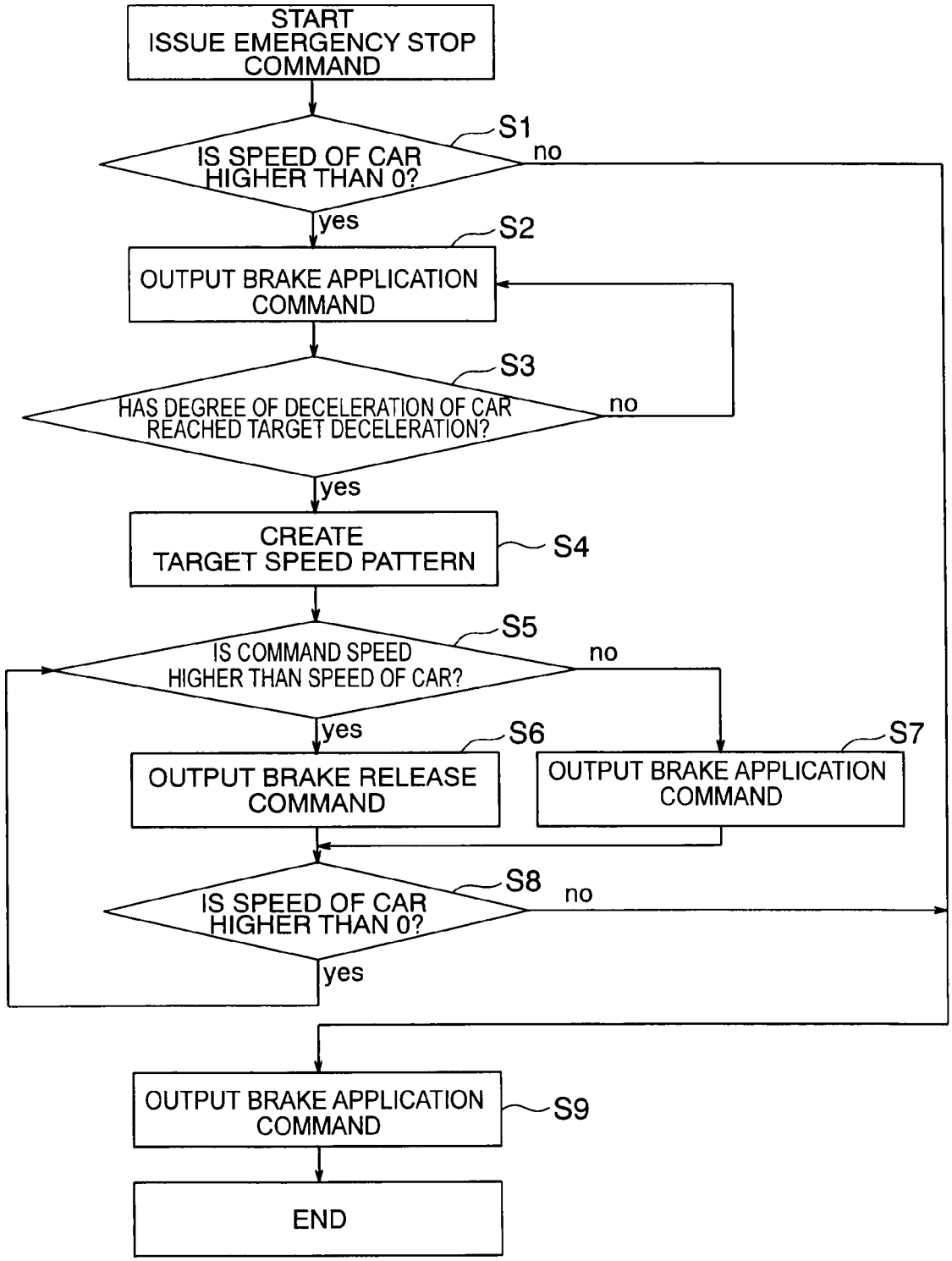
FIG. 4 is a flowchart showing an operation of a command generating portion of FIG. 2 at a time of the issuance of an emergency stop command.

FIG. 4 is a flowchart showing an operation of the command generating portion 23 of FIG. 2 at the time of the issuance of an emergency stop command. When the issuance of the emergency stop command is detected from information from the emergency braking detecting portion 21, the command generating portion 23 determines whether or not the speed of the car 1 (detected speed) is higher than 0 (Step S1). When the speed of the car 1 is 0, the emergency stop command turns out to have been issued during stoppage of the car 1. Therefore, deceleration control is not required, so the command generating portion 23 immediately outputs a brake application command (Step S9) to terminate the processings.

When the car 1 is running, the command generating portion 23 outputs a brake application command (Step S2), and waits until the degree of deceleration of the car 1 reaches a target deceleration (Step S3). When the degree of deceleration of the car 1 reaches the target deceleration, the command generating portion 23 creates a target speed pattern as shown in FIG. 3 (Step S4). The command generating portion 23 then compares a command speed based on the target speed pattern with the speed of the car 1 (Step S5). As a result, when the speed of the car 1 is lower than the command speed, the command generating portion 23 outputs a brake release command for reducing a braking force (Step S6). On the contrary, when the speed of the car 1 is equal to or higher than the command speed, the command generating portion 23 outputs a brake application command (Step S7).

After the braking force is adjusted as described above, the command generating portion 23 confirms whether or not the car 1 is stopped (Step S8). When the car 1 is not stopped, the command generating portion 23 repeatedly makes a comparison between the speed of the car 1 and the command speed and an adjustment of the braking force based on a result of the comparison. Then, when the car 1 is stopped, the command generating portion 23 outputs a brake application command (Step S9), thereby terminating the processings.

It should be noted herein that the brake release command for performing deceleration control at the time of emergency braking is not a command for completely releasing the brake device 9 but a command for reducing the braking force exerted by the brake device 9 to some extent. More specifically, the braking force applied to the brake pulley 8 is controlled by, for example, turning ON/OFF a switch for applying a voltage to the brake coils 11 with a predetermined switching duty.

In the elevator apparatus configured as described above, at the time of emergency braking of the car 1, the brake control device 19 monitors the speed of the car 1 and the degree of deceleration of the car 1. When the degree of deceleration of the car 1 reaches the target deceleration $\alpha$1, the target speed pattern for decelerating the car 1 from the speed of the car 1 at that time is created. Therefore, an excessively high deceleration can be prevented more reliably from being generated at the time of emergency braking regardless of a difference in the speed of the car 1 at the time of generation of a braking force.

Embodiment 2

Next, Embodiment 2 of the present invention will be described. An elevator apparatus according to Embodiment 2 of the present invention is different in a part of the operation of the command generating portion 23 from the elevator apparatus according to Embodiment 1 of the present invention. Embodiment 2 of the present invention is identical to Embodiment 1 of the present invention in other configurational and operational details.

Figure 5:
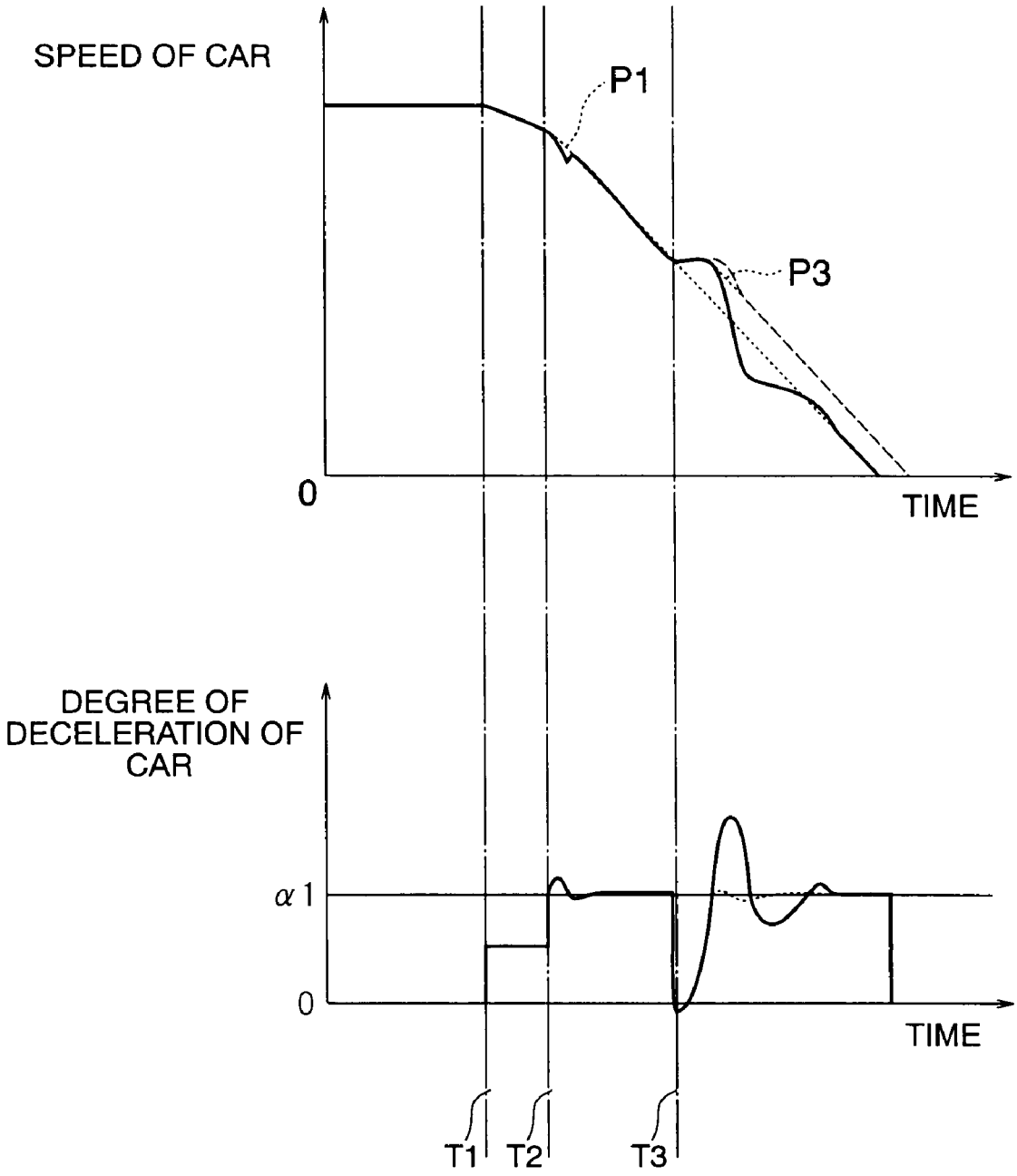
FIG. 5 includes graphs showing how the speed and the degree of deceleration of the car change with time, respectively, in the case where a large difference occurs between a command speed and the speed of the car due to an external influence.

During deceleration control according to Embodiment 1 of the present invention, a large difference may arise between the command speed and the speed of the car 1 due to an external influence such as the transmission of vibrations from within the car 1 or a frictional force between the car 1 and a guide rail. FIG. 5 includes graphs showing how the speed and the degree of deceleration of the car 1 change with time, respectively, in the case where a large difference occurs between the command speed and the speed of the car 1 due to the external influence.

Solid lines of FIG. 5 represent the speed and the degree of deceleration of the car 1, respectively, in the case where the car 1 is decelerated according to a control method of Embodiment 1 of the present invention. When the speed of the car 1 sharply deviates from the command speed due to the external influence at a time instant T3, the degree of deceleration of the car 1 temporarily increases to eliminate the difference between the speed of the car 1 and the command speed.

On the other hand, when the difference between the command speed and the speed of the car 1 exceeds a predetermined value, the brake control device 19 according to Embodiment 2 of the present invention generates a new target speed pattern P3 for decelerating the car 1 at the target deceleration $\alpha$1 from the speed of the car 1 at that time. Coarse broken lines of FIG. 5 represent the speed and the degree of deceleration of the car 1, respectively, in the case where deceleration control according to Embodiment 2 of the present invention is performed.

Figure 6:
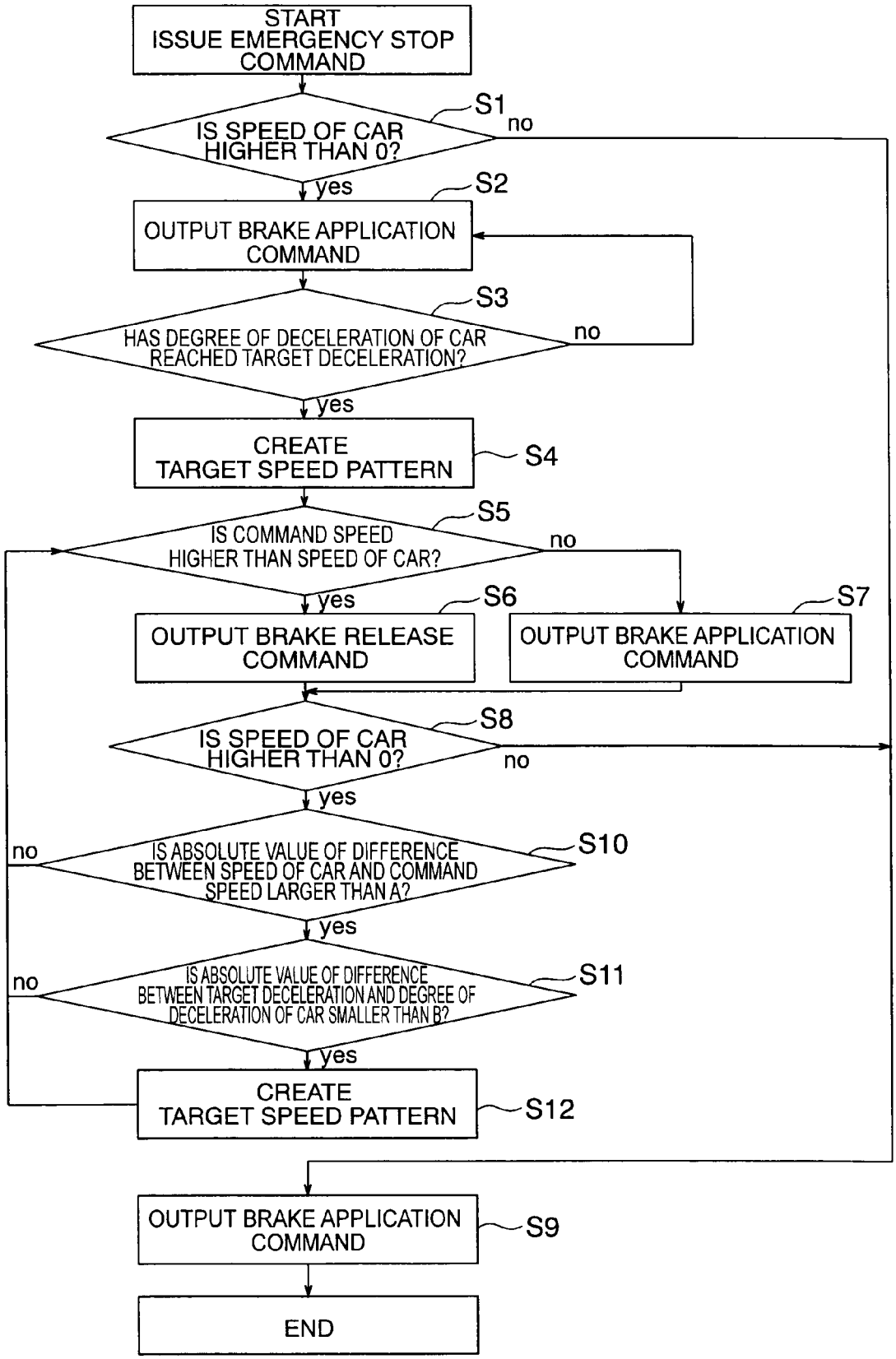
FIG. 6 is a flowchart showing an operation of a command generating portion according to Embodiment 2 of the present invention at the time of the issuance of an emergency stop command.

FIG. 6 is a flowchart showing an operation of the command generating portion 23 (FIG. 2) according to Embodiment 2 of the present invention at the time of the issuance of an emergency stop command. When the car 1 is running after the outputting of a brake release command (Step S6) or a brake application command (Step S7), the command generating portion 23 determines whether or not the absolute value of a difference between a detected speed of the car 1 and a command speed is larger than a threshold A (Step S10). The threshold A, which is a tolerance of a difference in speed due to an external influence, is set in advance.

When the difference between the speed of the car 1 and the command speed is equal to or smaller than the threshold A, deceleration control is continued according to the first generated target speed pattern. When the difference between the speed of the car 1 and the command speed is larger than the threshold A, the command generating portion 23 determines whether or not the absolute value of a difference between a target deceleration and a degree of deceleration of the car 1 is smaller than a threshold B (Step S11). The threshold B, which is a tolerance of the difference between the target deceleration and the degree of deceleration of the car 1, is set in advance.

When the difference between the target deceleration and the degree of deceleration of the car 1 is equal to or larger than the threshold B, deceleration control is continued according to the first generated target speed pattern. When the difference between the target deceleration and the degree of deceleration of the car 1 becomes smaller than the threshold B, the command generating portion 23 generates a new target speed pattern to update the first generated target speed pattern to the new target speed pattern (Step S12).

In the elevator apparatus configured as described above, the difference between the command speed based on the target speed pattern and the speed of the car 1 is monitored during deceleration control at the time of emergency braking. When the difference between the command speed and the speed of the car 1 exceeds the predetermined value, the new target speed pattern for decelerating the car 1 from the speed of the car 1 at that time is created. Therefore, the degree of deceleration of the car 1 can be prevented from becoming excessively high after a change in the speed of the car 1 due to an external influence.

Embodiment 3

Figure 7:
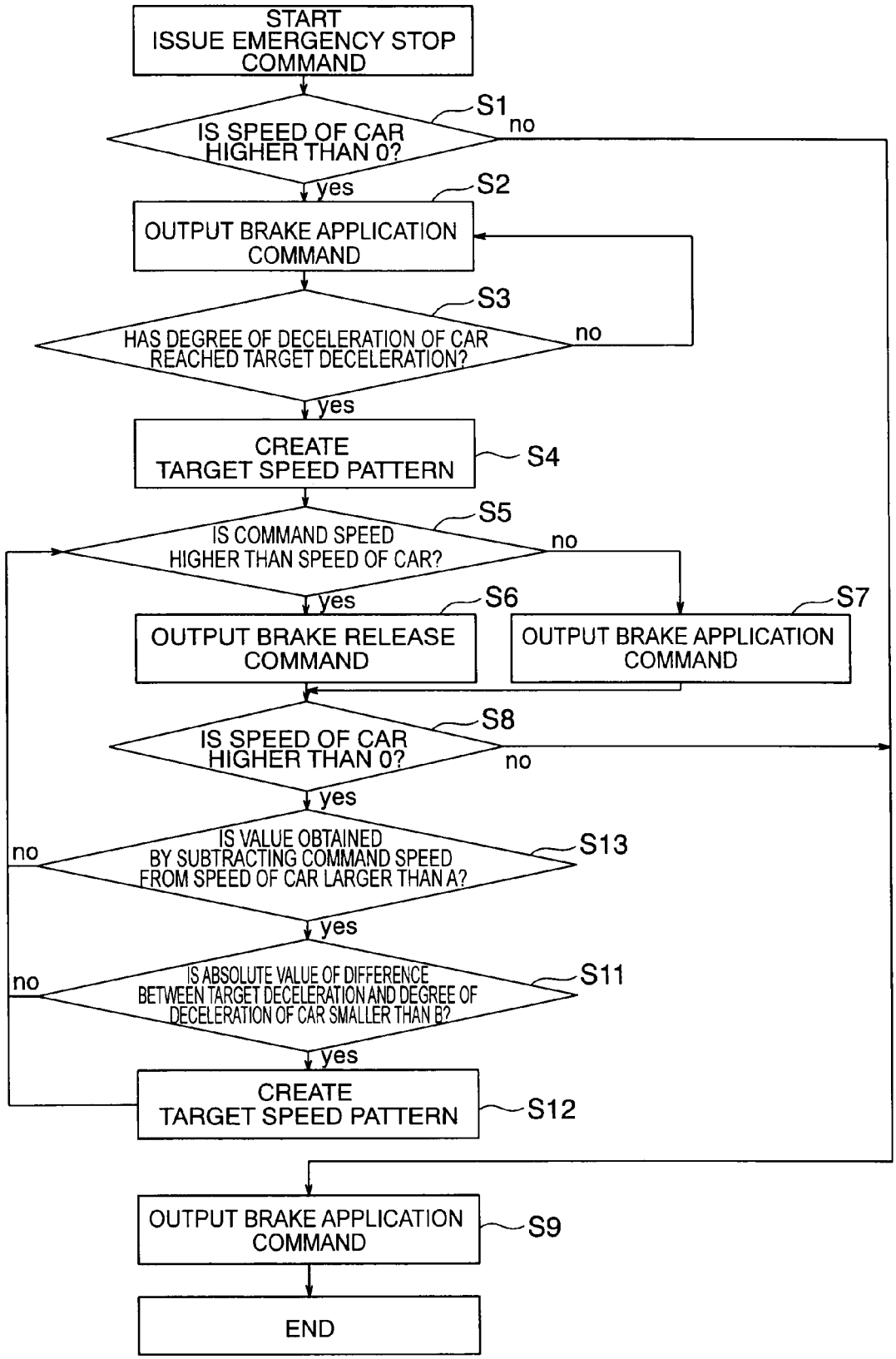
FIG. 7 is a flowchart showing an operation of a command generating portion according to Embodiment 3 of the present invention at the time of the issuance of an emergency stop command.

Reference will be made next to FIG. 7. FIG. 7 is a flowchart showing an operation of the command generating portion 23 (FIG. 2) according to Embodiment 3 of the present invention at the time of the issuance of an emergency stop command. In Embodiment 2 of the present invention, it is determined whether or not the absolute value of the difference between the speed of the car 1 and the command speed is larger than the threshold A. In Embodiment 3 of the present invention, however, it is determined whether or not a difference obtained by subtracting the command speed from the speed of the car 1 is larger than the threshold A (Step S13). That is, a new target speed pattern is created when the speed of the car 1 is higher than the command speed and the difference therebetween is larger than the threshold A. Embodiment 3 of the present invention is identical to Embodiment 2 of the present invention in other configurational and operational details.

According to the elevator apparatus configured as described above, the new target speed pattern is created only when the speed of the car 1 is higher than the command speed, so the target speed pattern does not become lower by being created again. Accordingly, the average degree of deceleration of the car 1 to the moment when the car 1 is stopped can be prevented from increasing.

Embodiment 4

Figure 8:
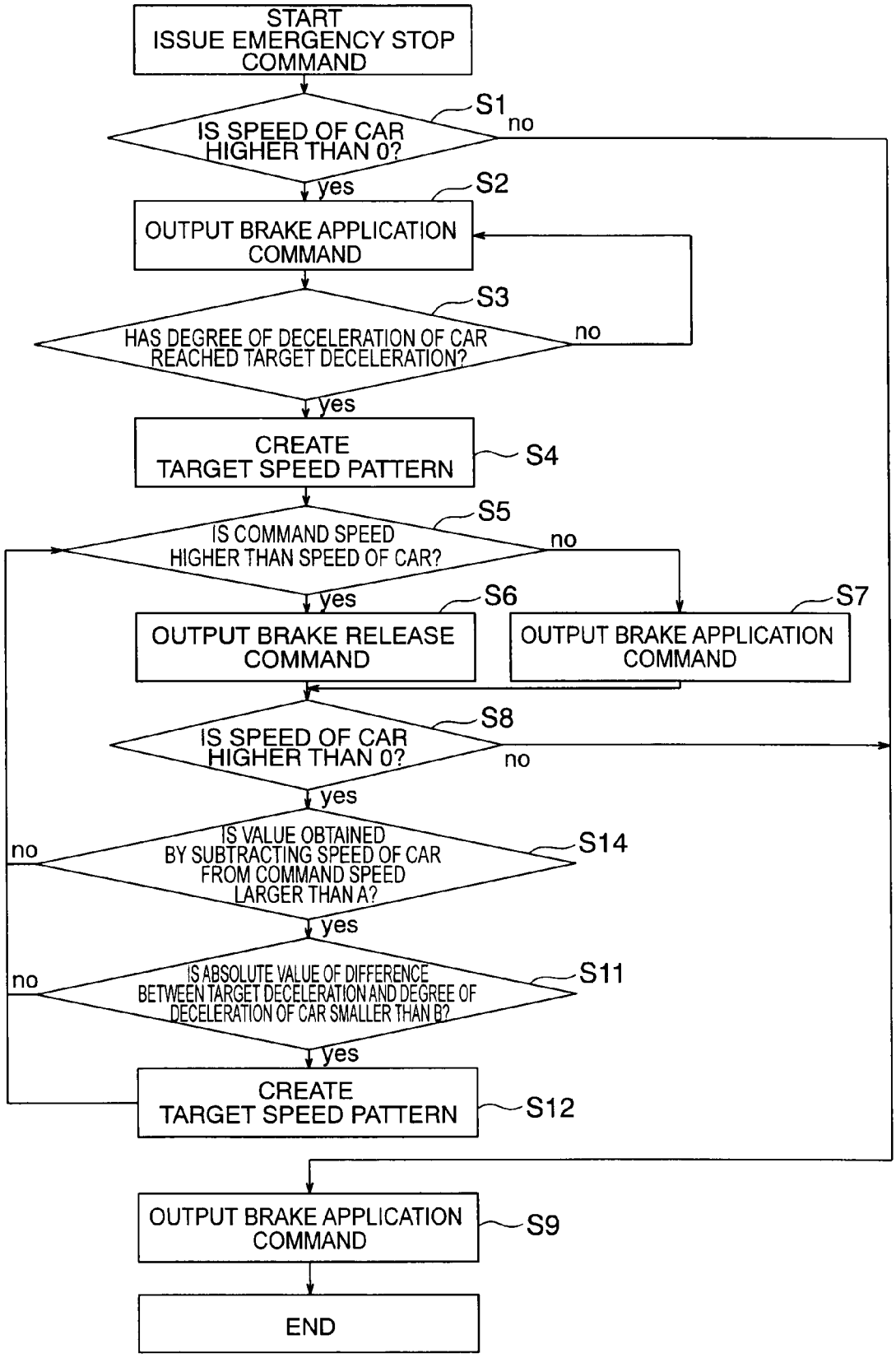
FIG. 8 is a flowchart showing an operation of a command generating portion according to Embodiment 4 of the present invention at the time of the issuance of an emergency stop command.

Reference will be made next to FIG. 8. FIG. 8 is a flowchart showing an operation of the command generating portion 23 (FIG. 2) according to Embodiment 4 of the present invention at the time of the issuance of an emergency stop command. In Embodiment 2 of the present invention, it is determined whether or not the absolute value of the difference between the speed of the car 1 and the command speed is larger than the threshold A. In Embodiment 4 of the present invention, however, it is determined whether or not a difference obtained by subtracting the speed of the car 1 from the command speed is larger than the threshold A (Step S14). That is, a new target speed pattern is created when the speed of the car 1 is lower than the command speed and the difference therebetween is larger than the threshold A. Embodiment 4 of the present invention is identical to Embodiment 2 of the present invention in other configurational and operational details.

According to the elevator apparatus configured as described above, the new target speed pattern is created only when the speed of the car 1 is lower than the command speed, so the target speed pattern does not become higher by being created again. Accordingly, the distance covered by the car 1 to the moment when the car 1 is stopped can be prevented from increasing.

In each of the foregoing examples, it is determined based on the signal from the elevator control device 18 whether or not the brake device 9 is in the emergency braking state. However, the brake control device may independently determine whether or not the brake device 9 is in the emergency braking state, regardless of the signal from the elevator control device. For example, it is appropriate to determine that the brake device 9 is in the emergency braking state, by detecting approach of the brake shoes to the brake pulley or contact of the brake shoes with the brake pulley. Alternatively, it is also appropriate to determine that the brake device 9 is in the emergency braking state, when the current value of each of the brake coils is smaller than a predetermined value although the speed of the car 1 is equal to or higher than a predetermined value.

In each of the foregoing examples, the speed of the car 1 and the degree of deceleration of the car 1 are calculated using the signal from the hoisting machine encoder 12. However, it is also appropriate to use a signal from another sensor, for example, the speed governor encoder 15. As a method of calculating the speed of the car 1 and the degree of deceleration of the car 1 from the signal from the encoder, a method of subjecting a difference in rotation of the hoisting machine, which is acquired at intervals of a certain time, to a differential processing can be mentioned.

Further, in each of the foregoing examples, the brake release command or the brake application command is generated to ensure that the speed of the car 1 changes along the target speed pattern. In this case, as a command voltage value, a value obtained through multiplication by a gain proportional to the deviation between the command speed and the speed of the car 1 may be used. That is, so-called proportional control may be performed. A component of the gain may include an integrator element or a derivative element of the difference between the command speed and the speed of the car 1.

Still further, in each of the foregoing examples, the degree of deceleration of the target speed pattern is equal to the target deceleration $\alpha 1$. However, the degree of deceleration of the target speed pattern may not necessarily be absolutely equal to the target deceleration $\alpha 1$. The degree of deceleration of the target speed pattern may not necessarily be constant but may be changed so as to round the target speed pattern.

The invention claimed is:

1. An elevator apparatus, comprising:

a car;

car speed detecting means;

car deceleration detecting means;

a brake device for braking running of the car; and a brake control device for controlling the brake device, wherein the brake control device monitors a speed of the car detected by the car speed detecting means and a degree of deceleration of the car detected by the car deceleration detecting means at a time of emergency braking of the car, and generates, at a time when the degree of deceleration of the car reaches a preset target deceleration, a target speed pattern for decelerating the car from a speed of the car at that time.

2. The elevator apparatus according to claim 1, wherein the brake control device generates a target speed pattern so as to maintain the target deceleration.

3. An elevator apparatus, comprising:

a car;

car speed detecting means;

a brake device for braking running of the car; and a brake control device for controlling the brake device, wherein the brake control device generates a target speed pattern for decelerating the car at a time of emergency braking thereof, monitors a difference between the target speed pattern and a speed of the car detected by the car speed detecting means, and generates, at a time when a difference between a command speed and the speed of the car exceeds a predetermined value, a new target speed pattern for decelerating the car from the speed of the car at that time.

4. The elevator apparatus according to claim 3, wherein the brake control device generates a target speed pattern so as to maintain the target deceleration.

5. The elevator apparatus according to claim 3, wherein the brake control device avoids generating a new target speed pattern when a difference between a degree of deceleration of the car and a target deceleration is equal to or larger than a predetermined value.

* * * * *